US009433334B2

(12) United States Patent
Tomm

(10) Patent No.: US 9,433,334 B2
(45) Date of Patent: Sep. 6, 2016

(54) DAMP MOP TOOL WITH HAND ACTIVATED LIQUID DISPENSER

(71) Applicant: Erwin Tomm, Cleveland, OH (US)

(72) Inventor: Erwin Tomm, Cleveland, OH (US)

( * ) Notice: Subject to any disclaimer, the term of this patent is extended or adjusted under 35 U.S.C. 154(b) by 101 days.

(21) Appl. No.: 14/054,032

(22) Filed: Oct. 15, 2013

(65) Prior Publication Data

US 2014/0101878 A1 Apr. 17, 2014

Related U.S. Application Data

(60) Provisional application No. 61/713,918, filed on Oct. 15, 2012.

(51) Int. Cl.
*A47L 13/22* (2006.01)
*A47L 13/30* (2006.01)

(52) U.S. Cl.
CPC ..... *A47L 13/22* (2013.01); *A47L 13/30* (2013.01)

(58) Field of Classification Search
CPC ..... A47L 13/22; A47L 13/30
USPC ..... 401/138, 150, 176, 177, 188 R, 139
See application file for complete search history.

(56) References Cited

U.S. PATENT DOCUMENTS 914,526 A * 3/1909 Stevens ..... A46B 11/0013 401/150
1,618,930 A 4/1926 Istrico
2,274,790 A * 3/1942 Housley ..... A46B 11/0055 222/340
2,305,158 A * 12/1942 Hanses ..... A46B 11/0055 222/260
2,388,321 A * 11/1945 Gereke ..... A01K 17/00 222/340
2,554,287 A * 5/1951 Wilson ..... A46B 11/0055 222/378
6,960,042 B1 * 11/2005 Hsiao ..... A47L 1/08 401/138
2004/0265037 A1 * 12/2004 Vosbikian et al. ..... 401/139
2006/0245820 A1 * 11/2006 Kresse ..... A47L 13/20 401/276
2010/0086342 A1 * 4/2010 Blom ..... 401/139

* cited by examiner

*Primary Examiner* — Mark A Laurenzi
*Assistant Examiner* — Bradley Oliver
(74) *Attorney, Agent, or Firm* — Fay Sharpe LLP

(57) ABSTRACT

A damp mop includes a handle with a bore that defines a reservoir for a volume of cleaning liquid. The neck includes a socket with an outlet chamber and a liquid outlet orifice is defined in the neck in communication with the outlet chamber. A handle tip is engaged with the neck socket and includes a flow passage in fluid communication with both reservoir and the outlet chamber. A rod is located in the handle and includes an inner end with a piston. The rod and piston are selectively manually movable between: (i) a retracted position in which liquid can flow from the reservoir into the outlet chamber; and (ii) an extended position in which the piston blocks flow of liquid. The piston pressurizes the outlet chamber when it moves from the retracted position to the extended position to cause cleaning fluid to be ejected from the outlet orifice.

8 Claims, 5 Drawing Sheets

DAMP MOP TOOL WITH HAND ACTIVATED LIQUID DISPENSER

CROSS-REFERENCE TO RELATED APPLICATION

This application claims priority from and benefit of the filing date of U.S. provisional application Ser. No. 61/713,918 filed Oct. 15, 2012, and the entire disclosure of said provisional application is hereby expressly incorporated by reference into the present application.

BACKGROUND

Damp mop tools are generally known to include a head that supports a cleaning element such as a pad or mop head and a handle connected to the head for user manipulation of the head across a floor being cleaned. A reservoir or container is connected to the handle for holding a volume of cleaning liquid such as soap and water. These prior devices have typically mounted the reservoir to the side of the handle, offset from the longitudinal axis of the handle in a manner that undesirably alters the balance of the handle which renders use of the device more difficult, especially if the user needs to rotate the handle against the weight of the reservoir. Such devices often use tubing for communicating liquid from the reservoir onto the floor and/or cleaning element by gravity, and a manually operated pinch valve or the like is used to control the flow of liquid through the tubing. Such systems become easily clogged and/or the tube becomes pinched or otherwise deformed and restricted sufficiently so that the flow of liquid is reduced below an acceptable level. Also, the tubing and valve system increase cost and complicate manufacturing. Also, in many such systems, a user must bend over to open the valve and allow liquid to flow from the reservoir, which is inconvenient and inefficient. Other systems used motorized pumps and electrically operated valves, but such systems require rechargeable batteries or another source of electrical power, and are too expensive to purchase and repair for many janitorial and similar applications.

Based upon the above deficiencies and others, a need has been identified for a non-motorized damp mop tool that overcomes the above drawbacks and others while providing better overall results.

SUMMARY

In accordance with one aspect of the present development, a damp mop tool includes a head including a body and a neck connected to the body. The body is adapted to be connected to an associated cleaning element. A handle includes an inner end connected to the neck and an outer end spaced from said inner end, and the handle is adapted to be held by a user. The handle includes an internal bore that defines a reservoir adapted for containing a volume of associated cleaning liquid. The neck includes an internal neck passage that defines a socket and an outlet chamber that communicates with the neck passage. At least one liquid outlet orifice is defined in the neck. The liquid outlet orifice includes a first end that opens through an external surface of the neck and includes a second end that is in fluid communication with the outlet chamber. A handle tip is connected to the inner end of the handle and is engaged with the socket of the neck. The handle tip includes a liquid flow passage including an inlet portion in fluid communication with the reservoir of the handle and an outlet portion in fluid communication with the outlet chamber of the neck. A flow control system controls the flow of liquid between the reservoir of the handle and the outlet chamber of the neck. The flow control system includes: (i) a rod located in and adapted for reciprocal sliding movement in the internal bore of the handle, the rod including an inner end and an outer end; and (ii) a piston connected to the inner end of the rod. The piston is conformed and dimensioned for close sliding fit within the outlet portion of the handle tip liquid flow passage. The rod and piston are selectively manually movable between: (i) a retracted position in which the piston is withdrawn from the outlet portion of the handle tip liquid flow passage such that liquid can flow from the reservoir of said handle into the outlet chamber of the neck; and (ii) an extended position in which the piston is extended into the outlet portion of the handle tip liquid flow passage. The piston pressurizes the outlet chamber and ejects liquid from the outlet chamber through the at least one liquid outlet orifice when the rod and piston move from the retracted position to the extended position.

In accordance with another aspect of the present development, a damp mop tool includes a head with a body and a neck connected to the body. The body is adapted to be connected to an associated cleaning element. A handle includes an inner end connected to the neck and an outer end spaced from the inner end. The handle is adapted to be held by a user and comprises an internal bore that defines a reservoir adapted for containing a volume of associated cleaning liquid. The neck includes a socket with an outlet chamber. At least one liquid outlet orifice is defined in the neck and includes a first end that opens through an external surface of the neck and a second end that is in fluid communication with the outlet chamber. A handle tip is engaged with the socket and includes a liquid flow passage having an inlet portion in fluid communication with the reservoir and an outlet portion in fluid communication with the outlet chamber of the socket. A rod is located in and adapted for reciprocal sliding movement in the internal bore of the handle. The rod includes an inner end with a piston. The rod and piston are selectively manually movable between: (i) a retracted position in which the piston is withdrawn from the outlet portion of the handle tip liquid flow passage such that liquid can flow from the reservoir into the outlet chamber; and (ii) an extended position in which the piston is located in the outlet portion of the handle tip liquid flow passage.

In accordance with another aspect of the present development, a damp mop includes a handle with a bore that defines a reservoir for a volume of cleaning liquid. A neck connects the handle to a cleaning head includes a socket with an outlet chamber and a liquid outlet orifice defined in the neck in communication with the outlet chamber. The handle includes a tip that is engaged with the neck socket and that includes a flow passage in fluid communication with both the reservoir and the outlet chamber. A rod is located in the handle and includes an inner end with a piston. The rod and piston are selectively manually movable between: (i) a retracted position in which liquid can flow from the reservoir into the outlet chamber; and (ii) an extended position in which the piston blocks flow of liquid from the reservoir into the outlet chamber. The piston pressurizes the outlet chamber when it moves from the retracted position to the extended position to cause cleaning fluid to be ejected from the outlet orifice.

DETAILED DESCRIPTION

Figure 1:
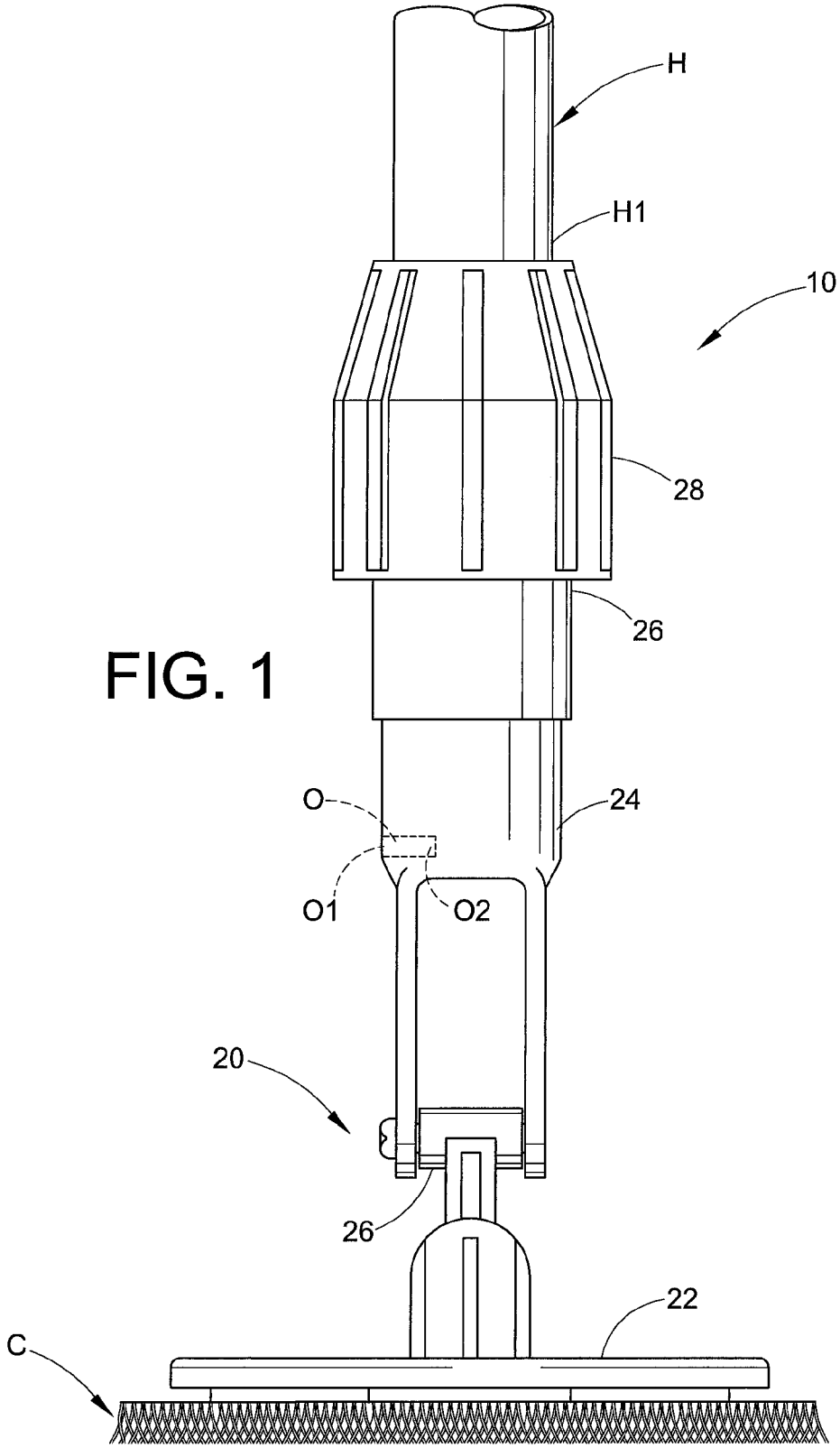
FIG. 1 is a side elevational view of a damp mop tool formed in accordance with the present development.

A damp mop device or tool 10 includes a mop head 20 including a body 22 and a neck 24 that is pivotally connected to the body by a connection hinge 26. Body 22 is preferably defined from a polymeric or other suitable material. Neck 24 is preferably a one-piece molded polymeric structure, but other materials can be used.

The body 22 includes or is adapted to be connected to a fabric or other type of cleaning element or mop cover C that is fixedly secured to the body 22 using hook-and-loop fastening elements and/or other suitable connection means. An elongated hollow tubular handle H includes an inner end H1 connected to the neck 24 of the mop head 20 and comprises an outer end H2 (FIG. 6) that is adapted to be held by a user in order to move the mop cover C across a floor or other surface being cleaned.

Figure 2:
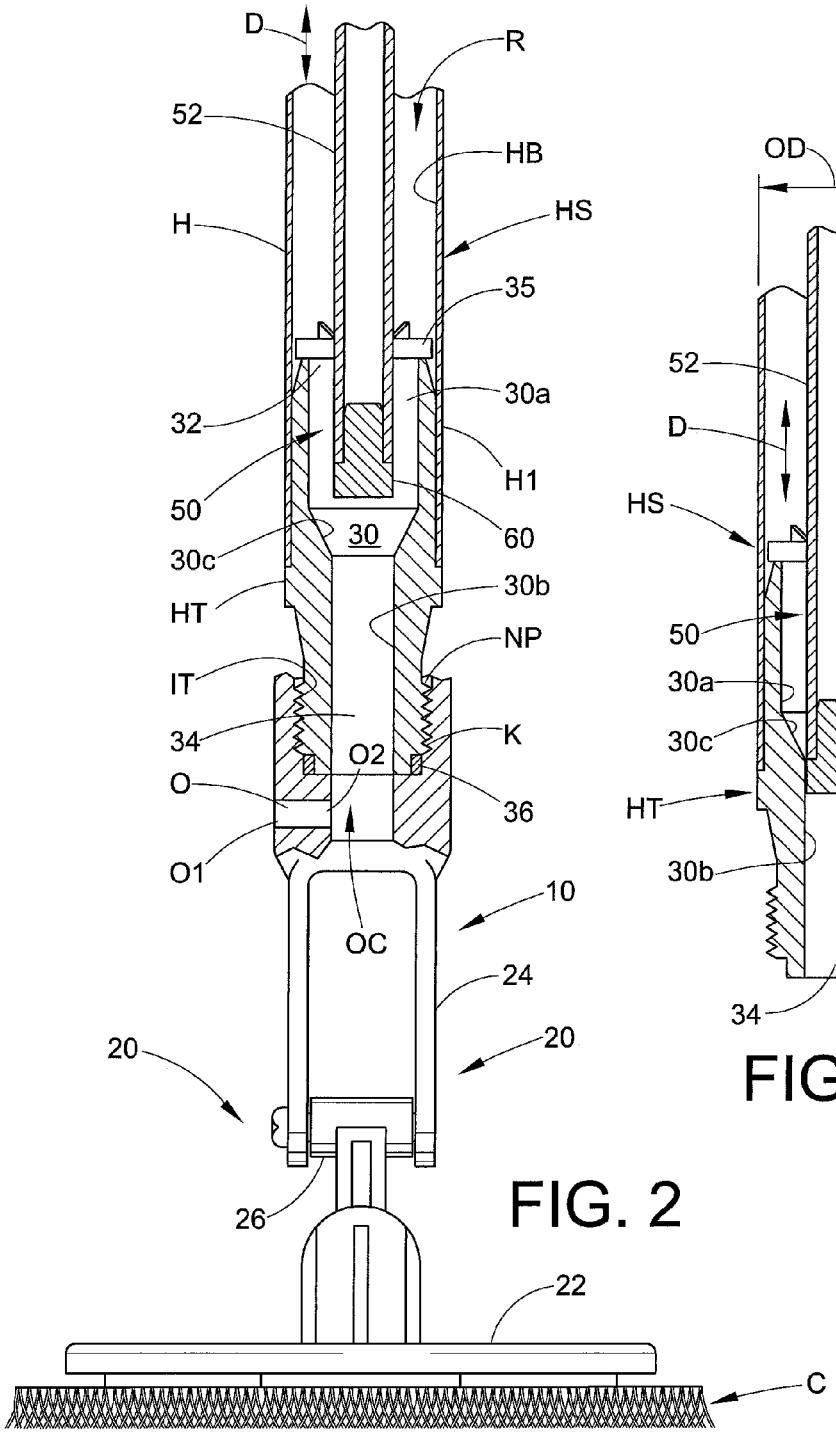
FIG. 2 is similar to FIG. 1, but shows portions of the damp mop tool broken away to reveal internal components, with the damp mop tool arranged with its flow control system in an opened configuration.

FIGS. 1 and 2 show that the neck 24 of the mop head 20 includes one or more liquid outlet orifices O defined therein. As shown in FIG. 2, each liquid outlet orifice O extends radially through the neck 24 from a first end O1 that opens through the outer wall of the neck 24 so as to communicate with the external environment surrounding the neck 24 to a second or inner end O2 that opens into a hollow outlet chamber OC defined in the neck 24. The neck 24 also defines a hollow, internal, axially extending neck passage NP that is in fluid communication with the outlet chamber OC at an inner, end and that is open at its opposite upper end to receive the handle H as described in more detail below. As such, the neck passage NP defines a socket K that is adapted to engage the handle H as described below, and at least part of the internal neck passage NP comprises internal threads IT to engage the handle H.

As also shown in FIG. 2, the handle H, itself, comprises a hollow internal bore HB that is adapted to contain and a volume of water or other liquid cleaning fluid. As such, the hollow internal bore HB of the handle H provides a reservoir R for containing a volume of water or other liquid cleaning fluid within the confines of the handle H uniformly distributed about the longitudinal axis of the handle H so as not to adversely affect the balance of the handle H. The handle comprises a uniform cylindrical outer surface HS having a maximum outside diameter OD, and the cleaning liquid reservoir R is contained within the dimensions of the maximum handle outside diameter OD, i.e., no part of the reservoir R is located radially outward from the maximum outside diameter OD.

Figure 4:
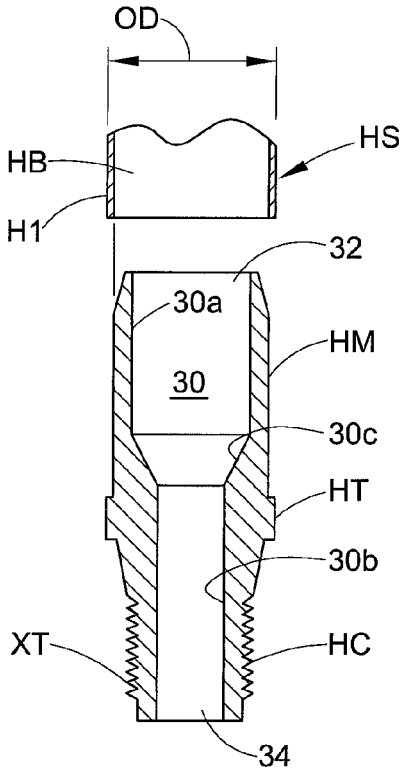
FIG. 4 is an exploded view of the tip of the handle portion.

The damp mop device 10 also comprises a handle tip HT that is fixedly secured to the inner end H1 of the handle H. In the illustrated embodiment as shown in FIG. 4 the handle tip HT comprises a mounting portion HM comprising projecting male fitting portion that is adapted to be received within the handle bore HB with a fluid-tight fit and that is glued or otherwise secured in position. Alternatively, the mounting portion HM comprises a female socket that receives and surrounds the inner end H1 of the handle with a fluid-tight fit and that is glued or otherwise secured in position. The handle tip HT also comprises an externally threaded connector portion HC that is adapted to mate with threaded engagement with the internally threaded socket K of the neck 24 when the external threads XT of the connector portion HC are advanced into mating engagement with the internal threads IT of the socket K. The neck 24 preferably also includes a collet structure 26 (FIG. 1) through which the handle H extends when the handle tip HT is engaged with the socket K. After the handle tip HT is fully threaded into and engaged with the socket K, a lock-nut 28 that is threaded onto the neck 24 is advanced on the neck 24 to radially constrict the collet structure 26 into gripping engagement with the outer surface of the handle H to inhibit reverse rotation of the handle tip HT in the socket K that would result in loosening or decoupling of the handle tip HT from the socket K.

The handle tip HT is preferably defined from a one-piece molded polymeric structure. The handle tip HT comprises an internal liquid flow passage 30 that extends axially there through from an inlet 32 of the passage 30 to an outlet 34 of the passage 30. When the handle tip HT is connected to the handle inner end H1, the internal bore HB of the handle H is in fluid communication with the inlet 32 of the flow passage 30. Also, when the handle tip HT is operatively engaged with the neck 24 of the mop head 20 as shown in FIG. 2, the outlet 34 of the flow passage 30 is in fluid communication with the outlet chamber OC of the neck 24. A resilient polymeric washer or other gasket member or seal 36 is located in the socket K at an interface between the handle tip HT and an internal surface or wall 24*w* of the neck 24 that defines the neck flow passage NP in order to prevent fluid flow out of the socket K between the handle tip HT and the neck 24 between the mated internal and external threads IT, XT.

As shown in FIG. 4, the handle tip flow passage 30 comprises a first or inlet portion 30*a* located adjacent its inlet 32 and comprise a second or outlet portion 30*b* located adjacent the outlet 34 of the flow passage 30. The outlet portion 30*b* is cylindrical and is smaller in diameter or cross-section than the inlet portion 30*a*. A frusto-conical tapered transition portion 30*c* converges radially inward as it extends from the inlet portion 30*a* to the outlet portion 30*b*.

The mop device 10 comprises a flow control system 50 for controlling the flow of cleaning liquid from within the handle bore HB into the handle tip flow passage 30 through its inlet 32 and into the outlet chamber OC and out of the neck 24 through the/each liquid outlet orifice O. As shown herein, the flow control system 50 comprises an elongated rod 52 that is coaxially or otherwise positioned to extend at least partially and preferably completely through the handle bore HB. A piston 60 is connected to and/or defined as part of the inner end 54 of the rod 52. As shown herein the piston 60 comprises a resilient polymeric member connected to the inner end of the rod 52. The outlet portion 30*b* of the handle tip flow passage 30 comprises a cylindrical cross section and bore wall, and the piston 60 is conformed and dimensioned to include a portion with a circular cross-section that fits into the cylindrical outlet portion 30*b* of the flow passage 30 with a close sliding fit with minimal clearance while still allowing the piston to slide in the outlet portion 30*b* of the flow passage 30.

Figure 5:
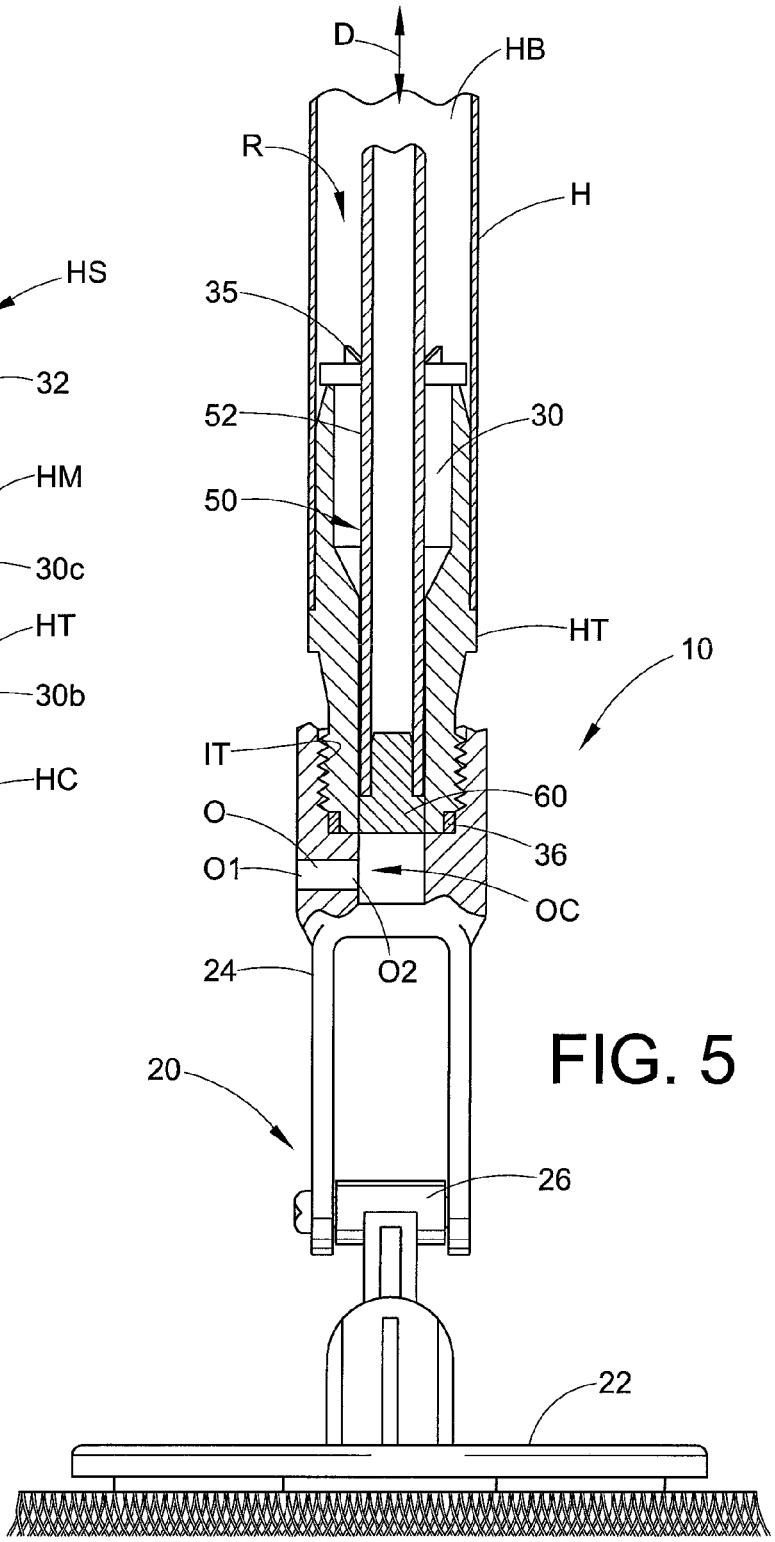
FIG. 5 is similar to FIG. 2, but shows the damp mop tool arranged with its flow control system in a pressurized liquid dispensing position.

The rod 52 is supported in the handle bore HB by one or more supports including a first rod support 35 that is secured to or defined as part of the handle tip HT adjacent the inlet 32 to the flow passage 30. The first rod support 35 slidably supports the rod 52 while still allowing fluid flow from the handle bore HB into the inlet portion 30*a* of the handle tip flow passage 30. The rod 52 is selectively manually movable in the handle bore HB coaxially relative to the longitudinal axis of the handle H in a reciprocal manner as indicated by the double-ended arrow D to and between: (i) a middle position (FIG. 3), in which the piston 60 is located at least partially in the outlet bore 30*b* and spaced from the outlet 34; (ii) a retracted position (FIG. 2) in which the piston 60 is withdrawn from the outlet portion 30*b* toward the inlet portion 30*a* sufficiently for liquid to flow by gravity from the inlet portion 30*a* (and handle bore HB) into the outlet portion 30*b* and through the outlet 34 into the outlet chamber OC substantially without being restricted by the piston 60; and (iii) a forward or extended position (FIG. 5) in which the piston 60 is extended into the outlet portion 30*b* toward (or through) the outlet 34 as compared to the middle position of FIG. 3. When the piston 60 is located in its extended position, it can be said to be seated against the outlet portion 30*b* so as to block the flow of cleaning liquid from the inlet portion 30*a* and transition portion 30*c* through the outlet portion 30*b* to the outlet chamber OC, and when the piston 60 is moved to its retracted position, it can be said to be unseated to allow flow of cleaning liquid by gravity from the inlet portion 30*a* and transition portion 30*c* through the outlet portion 30*b* to the outlet chamber OC and out thought the outlet orifice(s) O. The converging transition portion 30*c* also guides the piston 60 into the outlet portion 30*b* of the handle tip flow passage 30 as the piston 60 moves axially inward from its retracted position to its extended position.

Figure 3:
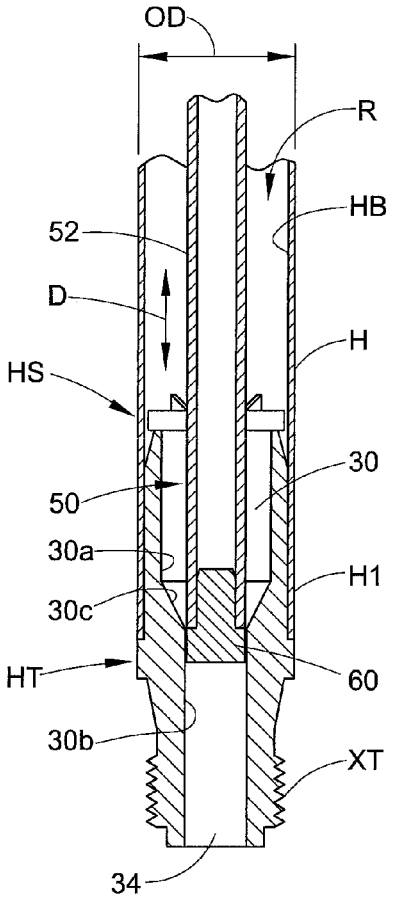
FIG. 3 is a section view that shows the tip of the handle portion of the damp mop tool by itself, with the flow control system in a middle position.

Those of ordinary skill in the art will recognize the when the rod 52 and piston 60 are located in the middle position of FIG. 3, the piston 60 is sufficiently engaged with the internal walls of the flow passage 30 to at least substantially block the flow of cleaning liquid from the handle bore HB and the inlet portion 30*a* of the flow passage 30 into the outlet portion 30*b* and outlet chamber OC by gravity so that the cleaning liquid does not continuously flow from the handle bore HB through the outlet orifices O to provide a "closed" position for the flow control system 50. When the rod 52 and piston 60 are moved from the middle position (FIG. 3) to the withdrawn position (FIG. 2), an "opened" position of the flow control system 50 is provided in which cleaning liquid will flow by gravity from the handle bore HB into the inlet portion 30*a* of the flow passage 30, and from there into the outlet portion 30*b* and also into the outlet chamber OC and out of the orifices O. When the rod 52 and piston 60 are moved from the middle position or from the retracted/withdrawn (opened) position to the extended/forward position of FIG. 5, the outlet portion 30*b* and outlet chamber OC are pressurized by the movement of the piston 60 into the outlet portion 30*b* such that cleaning fluid located in the outlet portion 30*b* of the flow passage 30 and/or in the outlet chamber OC is ejected in a pressurized stream from each outlet orifice O onto the floor or other surface being cleaned and/or onto the mop cover C.

Figure 6:
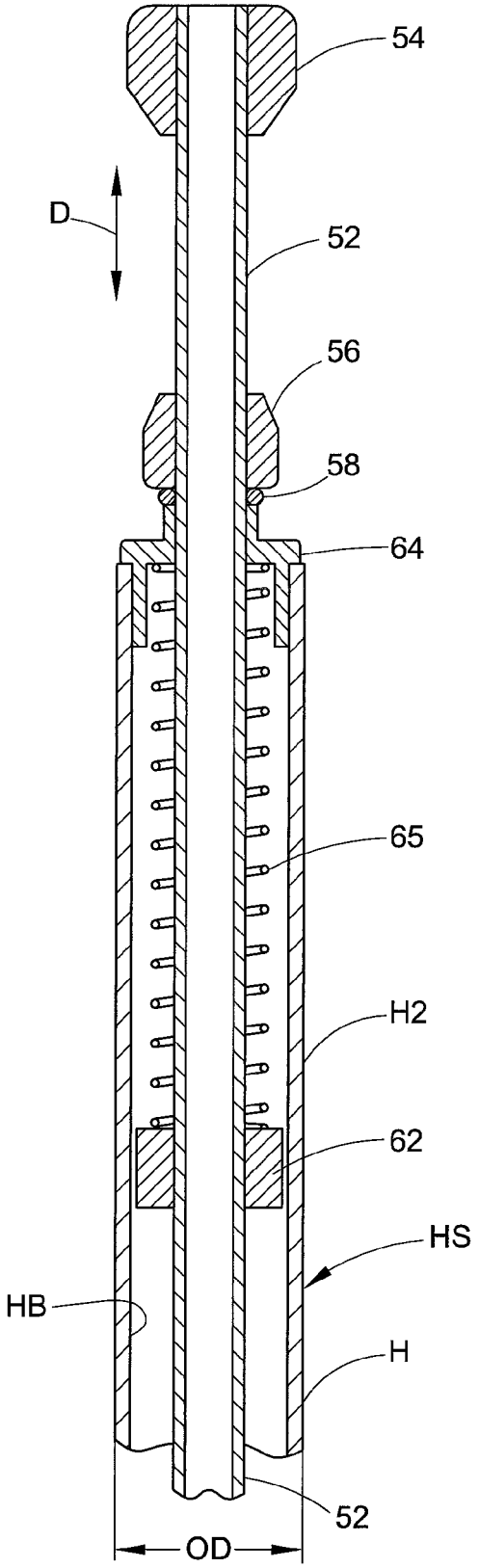
FIG. 6 is a section view of an outer end of the handle of the damp mop tool.

The rod 52 is spring-biased toward or fully into its extended position (FIG. 5), at least to its intermediate position of FIG. 3, to normally close the flow control system 50 and prevent the flow of cleaning liquid from the handle bore HB through the outlet orifices O. As shown in FIG. 6, the outer end H2 of the handle H which is spaced from the tip HT, includes an end cap 64 through which the rod 52 extends externally from the handle bore HB with a close sliding interface. The end cap 64 seals the handle bore HB to inhibit escape of cleaning liquid. The outer end of the rod 52 includes one or more radially enlarged protuberances such as an outer protuberance 54 and an inner protuberance 56. The outer protuberance 54 provides a gripping portion for a user to pull the rod 52 toward and into its withdrawn position to open the flow control system 50. The inner protuberance 56 acts as a stop to limit inward sliding movement of the rod 52 when the rod and piston 60 are moved to the extended/forward position. The inner protuberance 56 also acts to inhibit leakage of cleaning liquid between the rod 52 and the end cap 64, and an O-ring or other seal 58 is preferably included at this interface for the same purpose. A spring 65 such as a helical coil spring or other spring element is coaxially positioned about the rod 52 inside the handle bore HB and is captured between a spring stop 62 affixed to the rod 52 and the end cap 64. When the rod 52 is moved toward its withdrawn position, the spring 65 is compressed between the spring stop 62 and the end cap 64. Upon the rod 52 being released, the spring 65 resiliently biases the rod 52 toward its extended position, at least to its middle position (FIG. 3) if not completely to its extended position (FIG. 5) in order to close the flow control system 50 and block flow of cleaning liquid from the reservoir R to the outlet orifice O.

Figure 7:
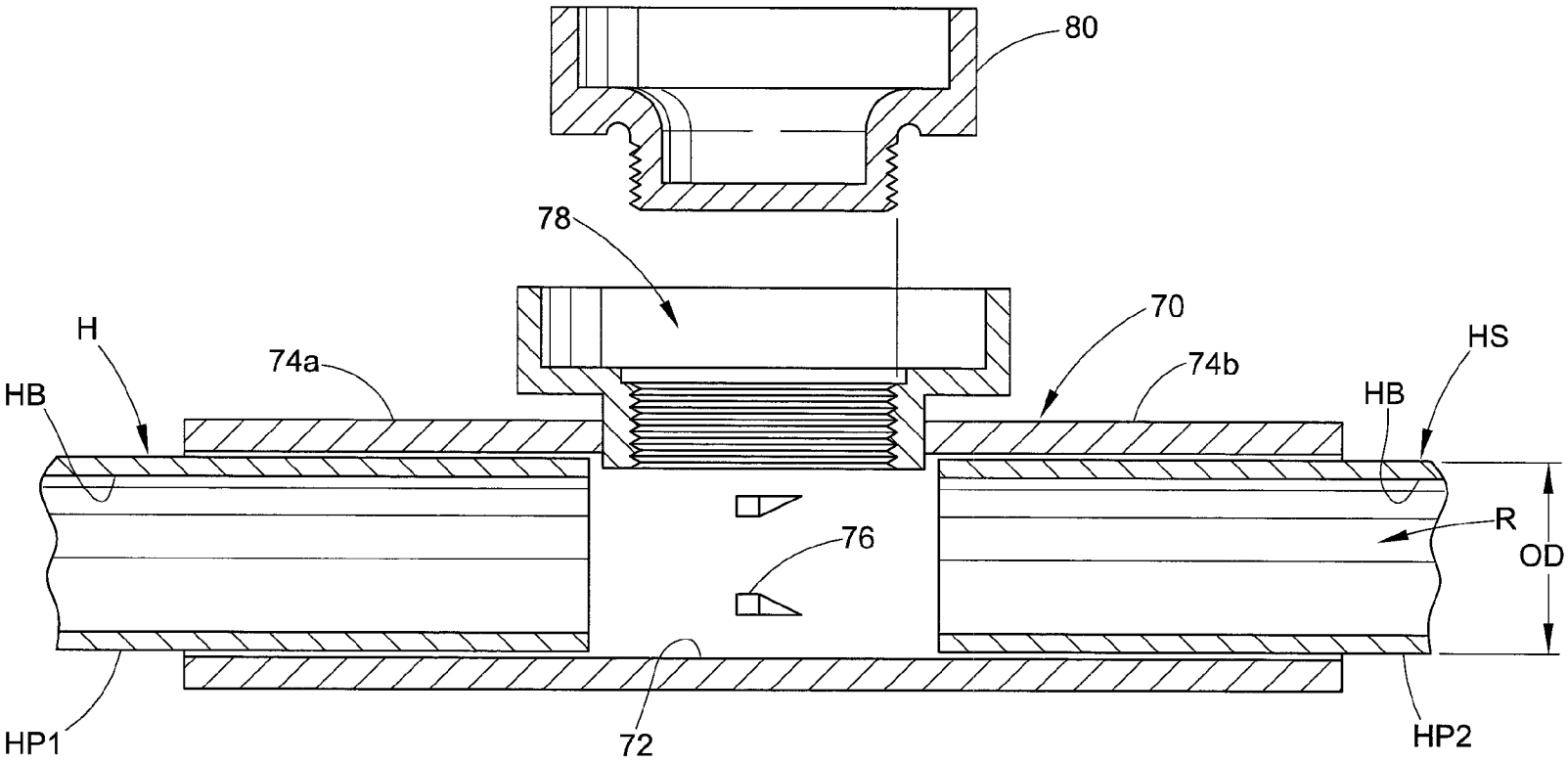
FIG. 7 is a section view of a fill valve portion of the damp mop tool and its connection to upper and lower handle portions.

As shown in FIG. 7, in the illustrated embodiment, the handle H comprises a first handle portion HP1 and a second handle portion HP2, joined together by a coupler 70. Each handle portion HP1,HP2 comprises a cylindrical hollow tubular member defined from aluminum or other metal or a polymeric material. The handle portions HP1,HP2 and the coupler 70 together define the handle H. The coupler 70 physically and fluidically joins the first and second handle portions HP1,HP2 such that the internal bore HB of each handle portion HP1,HP2 is in fluid communication with the other through the coupler 70. The coupler 70 is located between the tip HT and the end cap 64, preferably in a middle region of the handle H between its inner and outer ends H1,H2. The coupler 70 comprises a hollow central passage 72 and comprises opposite first and second receivers 74*a*,74*b* into which (or, alternatively, over which) the first and second handle portions HP1,HP2 are respectively received and retained with a fluid-tight fit for communication with the hollow central passage 72. The coupler 70 also preferably comprises a second rod support 76 through which the rod 52 extends such that the second rod support 76 centers and slidably supports the rod 52 in the handle bore HB. The coupler 70 comprises a fill opening 78 that communicates with its hollow central passage 72 and thus with the handle bore HB. The fill opening 78 provides access to the handle bore HB for filling the handle bore reservoir R with liquid cleaning fluid. A threaded or otherwise reclosable/removable cap 80 is used to selectively close and seal the fill opening 78. A screen optionally extends across the fill opening 78 to prevent debris from entering the handle bore HB. When the coupler 70 is provided, the reservoir R, including the coupler central passage 72, is still contained radially within the dimensions of the outside diameter of the first and second handle portions HP1,HP2, although parts of the coupler 70 do extend radially outward beyond the outside diameter of the first and second handle portions HP1,HP2, but not sufficiently to undesirably alter the balance of the device 10. It is still deemed to be within the scope and intent of the present development if the central passage 72 or other part of the coupler 70 defines a part of the reservoir R that is located radially outward relative to the outside diameter of the first and second handle portions HP1,HP2, provided at least substantially the full volume of the reservoir R (i.e., ≥90%) is located inside the bores HB of the first and second handle portions HP1,HP2 and, thus, is contained radially within the dimensions of the maximum outside diameter OD of the first and second handle portions HP1,HP2.

The damp mop 10 advantageously provides a balanced distribution of the weight of the liquid cleaning fluid contained in the handle bore reservoir HB, given that the handle bore HB retains the cleaning fluid such that the weight of the cleaning fluid is evenly distributed about the longitudinal axis of the handle H, as opposed to known devices including a reservoir that projects outward from one side only of the handle. Cleaning liquid is dispensed as desired without using motorized pumps or complicated tubing and valve systems that are subject to malfunction.

The invention has been described with reference to preferred embodiments. Modifications and alterations will occur to those of ordinary skill in the art to which the invention pertains, and it is intended that the claims be construed as broadly as possible while maintaining their validity so as to encompass such modifications and alterations.

The invention claimed is:

1. A damp mop tool comprising:

a head including a body and a neck connected to the body, said body adapted to be connected to an associated floor cleaning element;

a handle comprising an inner end connected to the neck and an outer end spaced from said inner end, said handle adapted to be held by a user and comprising an internal bore that defines a reservoir adapted for containing a volume of associated cleaning liquid;

said neck comprising an internal neck passage that defines a socket and an outlet chamber that communicates with said neck passage;

at least one liquid outlet orifice defined in said neck, said liquid outlet orifice including a first end that opens through an external surface of the neck and including a second end that is in fluid communication with said outlet chamber;

a handle tip connected to the inner end of the handle and engaged with said socket of said neck, said handle tip comprising a liquid flow passage including an inlet portion in fluid communication with said reservoir of said handle and an outlet portion in fluid communication with said outlet chamber of said neck, wherein said neck passage comprises internal threads and said handle tip comprises external threads engaged with said internal threads of said neck passage to connect said handle tip to said neck;

a seal located between said handle tip and an internal surface of said neck passage to inhibit flow of cleaning liquid between said handle tip and said internal surface of said neck passage;

a flow control system for controlling the flow of liquid between said reservoir of said handle and said outlet chamber of said neck, said flow control system comprising: (i) a rod located in and adapted for reciprocal sliding movement in said internal bore of said handle, said rod comprising an inner end and an outer end; and (ii) a piston connected to the inner end of said rod, said piston conformed and dimensioned for close sliding fit within said outlet portion of said handle tip liquid flow passage;

said rod and piston selectively manually movable between: (i) a retracted position in which the piston is withdrawn from said outlet portion of said handle tip liquid flow passage such that liquid can flow from said reservoir of said handle into said outlet chamber of said neck; and (ii) an extended position in which the piston is extended into the outlet portion of said handle tip liquid flow passage;

wherein said piston is defined from a resilient polymeric material and fits closely and slidably within said outlet portion of said handle tip liquid flow passage such that said piston pressurizes said outlet chamber and ejects liquid from said outlet chamber through said at least one liquid outlet orifice when said rod and piston move from said retracted position to said extended position;

said outer end of said handle comprising an end cap and said outer end of said rod extending outwardly from said internal bore of said handle through said end cap such that said outer end of said rod is adapted to be manually grasped by a user to move said rod and piston between the retracted and extended positions;

said damp mop tool further comprising:

a spring located within said internal bore of said handle to resiliently bias said rod and piston toward the extended position, wherein said rod comprises a spring stop connected thereto, and wherein said spring is captured between said spring stop and said end cap.

2. The damp mop tool as set forth in claim 1, wherein said outer end of said rod comprises an outer protuberance that defines a gripping portion and an inner protuberance that defines a stop for engaging said end cap, wherein both said outer protuberance and said inner protuberance are located outside said bore of said handle, said damp mop tool further comprising a seal located between said inner protuberance and said end cap for inhibiting leakage of cleaning liquid between said end cap and said rod.

3. The damp mop tool as set forth in claim 1, wherein said inlet portion of said handle tip liquid flow passage is larger in cross-section than said outlet portion of said handle tip liquid flow passage, and said handle tip liquid flow passage further includes a transition portion that connects said inlet portion to said outlet portion, said transition portion converging radially inward as it extends from the inlet portion to the outlet portion.

4. The damp mop tool as set forth in claim 1, further comprising a rod support connected to said handle tip and slidably supporting said rod within said internal bore of said handle.

5. The damp mop tool as set forth in claim 1, wherein said handle comprises:

a first handle portion;

a second handle portion; and, a coupler that joins said first and second handle portions together, each of said first and second handle portions comprising a respective internal bore and said coupler comprising a central passage that fluidically connects said internal bore of said first handle portion to said internal bore of said second handle portion;

said coupler comprising a fill opening that communicates with said central passage and comprising a removable cap for selectively closing said fill opening.

6. The damp mop tool as set forth in claim 5, wherein said coupler comprises a rod support located in said central passage and slidably supporting said rod for reciprocal sliding movement.

7. The damp mop tool as set forth in claim 1, wherein said handle comprises a cylindrical outer surface having a maximum outside diameter dimension, and wherein said reservoir is at least substantially radially contained within said maximum outside diameter dimension.

8. The damp mop tool as set forth in claim 1, wherein said handle comprises a cylindrical outer surface having a maximum outside diameter dimension, and wherein said reservoir is completely radially contained within said maximum outside diameter dimension.

* * * * *